US006935238B2

(12) United States Patent
Kawamura et al.

(10) Patent No.: US 6,935,238 B2
(45) **Date of Patent: *Aug. 30, 2005**

(54) IMAGE RECORDING MATERIAL CONVEYING DEVICE AND AUTOMATIC IMAGE RECORDING SYSTEM

(75) Inventors: Yoshinori Kawamura, Kanagawa (JP); Takashi Koizumi, Kanagawa (JP); Kazuoki Komiyama, Kanagawa (JP); Yoshihiro Koyanagi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 49 days.

This patent is subject to a terminal disclaimer.

(21) Appl. No.: 10/680,404

(22) Filed: Oct. 8, 2003

(65) Prior Publication Data

US 2004/0134367 A1 Jul. 15, 2004

(30) Foreign Application Priority Data

Oct. 9, 2002 (JP) ..... 2002-296059

(51) Int. Cl.[7] ..... B65H 3/08; B65H 5/10; B41L 47/14

(52) U.S. Cl. ..... 101/477; 101/401.1; 271/11; 271/107; 271/98; 414/797

(58) Field of Search ..... 101/477, 401.1, 101/483; 271/10.01, 11, 97, 98, 105, 107, 104, 275, 276; 347/262, 264; 414/797, 797.2

(56) References Cited

U.S. PATENT DOCUMENTS

| | | | | | |
|---|---|---|---|---|---|
| 4,402,592 | A | * | 9/1983 | Schon et al. | 399/166 |
| 6,341,932 | B1 | * | 1/2002 | Otsuji | 414/403 |
| 6,550,388 | B2 | * | 4/2003 | McIlwraith | 101/477 |
| 6,729,237 | B2 | * | 5/2004 | Kawamura et al. | 101/477 |
| 2004/0112233 | A1 | * | 6/2004 | Shibabuki et al. | 101/477 |
| 2004/0112534 | A1 | * | 6/2004 | Koizumi et al. | 156/344 |

FOREIGN PATENT DOCUMENTS

| | | | |
|---|---|---|---|
| JP | 2000-247459 A | | 9/2000 |
| JP | 2000-247489 A | * | 9/2000 |
| JP | 2002-247489 A | | 9/2000 |

* cited by examiner

*Primary Examiner*—Leslie J. Evanisko
(74) *Attorney, Agent, or Firm*—Sughrue Mion, PLLC

(57) ABSTRACT

A conveying device for a printing plate precursor which takes the printing plate precursor and an interleaf sheet out from a cassette, and which, along a conveying path to an exposure section, takes-off only the interleaf sheet. When a leading end of the interleaf sheet passes by an interleaf sheet peeling roller disposed on the conveying path, the interleaf sheet peeling roller rotates in a direction opposite to a direction of conveying to the exposure section, and contacts the interleaf sheet, and slack is formed in the interleaf sheet between the interleaf sheet peeling roller and a conveying roller. A slack portion is nipped between two belts and fed to a forked-off path, and the interleaf sheet is removed from the conveying path. It is possible to feed only the printing plate precursor out to the exposure section while continuing to convey the printing plate precursor.

15 Claims, 4 Drawing Sheets

IMAGE RECORDING MATERIAL CONVEYING DEVICE AND AUTOMATIC IMAGE RECORDING SYSTEM

CROSS-REFERENCE TO RELATED APPLICATION

This application claims priority under 35 USC 119 from Japanese Patent Application No. 2002-296059, the disclosure of which is incorporated by reference herein.

BACKGROUND OF THE INVENTION

1. Field of the Invention

The present invention relates to an image recording material sheet conveying (sleet-feeding) device and an automatic image recording system which take an image recording material and an interleaf sheet simultaneously out from a cassette which accommodates the image recording materials, in which an image recording surface is provided on a support, and the interleaf sheets, which are thin-film-like and protect the image recording surface, in a state in which the image recording materials and the interleaf sheets are alternately stacked, and then feed the image recording material and the interleaf sheet to subsequent processes.

2. Description of the Related Art

A technique (printing plate precursor exposing device) has come to be developed which, by using an image recording material (printing plate precursor) in which an image recording surface (a photosensitive layer) is provided on a support, records an image directly by a laser beam or the like onto the photosensitive layer of the printing plate precursor. With such a technique, it is possible to quickly record an image onto a printing plate precursor (which will be called a printing plate hereinafter).

In an automatic printing plate exposing device which records images onto printing plates, the printing plates are taken out one-by-one from a cassette in which a plurality of the printing plates are stacked, and are fed to an exposure section (see Japanese Patent Application Laid-Open (JP-A) Nos. 2000-247489 and 2000-247459).

Here, when the printing plates are stacked in the cassette, in order to prevent the photosensitive layers thereof from being scratched, interleaf sheets, which are thin-film-like protective sheets, are inserted between the printing plates. Thus, within the cassette, the printing plates and the interleaf sheets are stacked alternately.

The interleaf sheet has the important function of protecting, in particular, the photosensitive layer of the printing plate. However, the interleaf sheet is not needed at the time of exposure in the exposure section. Therefore, the interleaf sheet must be taken out from the cassette and taken off of the printing plate by the time the printing plate reaches the exposure section.

When the printing plate is taken out from the cassette, the material which exists next as the uppermost layer in the cassette is an interleaf sheet. The interleaf sheet must be taken off by a different mechanism and via a different path. The current situation is that the printing plates and the interleaf sheets are separately taken out one-by-one from the cassette.

In this way, the interleaf sheet must be eliminated from the cassette by a separate mechanism, there are various restrictions on conventional sheet conveying devices which convey printing plates from the cassette to the exposure section, and a complex structure is required.

Moreover, also at the time when printing plate is carried out of the cassette and is automatically conveyed to an image recording device, the existence of the interleaf sheet is an obstacle to automation and leads to a deterioration in work efficiency.

SUMMARY OF THE INVENTION

In view of the aforementioned, an object of the present invention is to provide an image recording material sheet conveying device which takes an image recording material and an interleaf sheet out without separating the image recording material and the interleaf sheet, and which can convey only the image recording material to a subsequent process without scratching the image recording surface of the image recording material.

In addition to the above object, another object of the present invention is to provide an automatic image recording system which, in the processes from the taking-out from a cassette to the recording of an image, can improve the workability for taking off an interleaf sheet and can realize efficient automation processing.

A first aspect of the present invention is an image recording material sheet conveying device comprising: a cassette accommodating section having a cassette in which image recording materials and interleaf sheets are accommodated in a state of being stacked alternately, where the image recording material is sheet-shaped and has a support and an image recording surface is formed on one surface of the support, and the interleaf sheet is sheet-shaped and is for protecting the image recording surface; a take-out mechanism taking a pair of the image recording material and the interleaf sheet out from the cassette in a state in which the interleaf sheet is superposed on the image recording material; a conveying mechanism receiving the pair of the image recording material and the interleaf sheet from the take-out mechanism, and conveying the pair of the image recording material and the interleaf sheet in a predetermined conveying direction along a conveying path, a peeling mechanism peeling, at the conveying path, the interleaf sheet from the image recording material; and an interleaf sheet conveying mechanism conveying the interleaf sheet, which has been peeled-off, along a path which is different than the conveying path.

A second aspect of the present invention is an automatic image recording system comprising a cassette accommodating section having a cassette in which image recording materials and interleaf sheets are accommodated in a state of being stacked alternately, where the image recording material is sheet-shaped and has a support and an image recording surface is formed on one surface of the support, and the interleaf sheet is sheet-shaped and is for protecting the image recording surface; a take-out mechanism taking a pair of the image recording material and the interleaf sheet out from the cassette in a state in which the interleaf sheet is superposed on the image recording material; a conveying mechanism receiving the pair of the image recording material and the interleaf sheet from the take-out mechanism, and conveying the pair of the image recording material and the interleaf sheet in a predetermined conveying direction along a conveying path; a peeling mechanism peeling, at the conveying path, the interleaf sheet from the image recording material; an interleaf sheet conveying mechanism conveying the interleaf sheet, which has been peeled-off, along a path which is different than the conveying path; and an exposure station having a drum and a recording head, and training the image recording material, which has been separated from the interleaf sheet conveyed by the conveying mechanism, around the drum, and while rotating the drum at high speed, illuminating a light beam from the recording head, and moving the recording head relative to the drum and thereby recording an image on the image recording material.

A third aspect of the present invention is an image recording material sheet conveying device comprising: a cassette accommodating section accommodating at least two cassettes which are disposed one above another in a vertical direction and in which image recording materials and interleaf sheets are accommodated in a state of being stacked alternately, where, at the image recording material, an image recording surface is provided on a support, and the interleaf sheet is thin-film-shaped and protects the image recording surface; a carry-out mechanism simultaneously carrying the image recording material and the interleaf sheet as a pair out from the cassette in a state in which the interleaf sheet and the image recording material are superposed with the interleaf sheet on a top side and the image recording material at a bottom side; a conveying mechanism which, after the pair of the image recording material and the interleaf sheet have been selectively carried out from the plural cassettes by the carry-out mechanism, conveys the pair of the image recording material and the interleaf sheet from a carry-out position along a predetermined conveying path; a peeling mechanism provided along the conveying path of the conveying mechanism and peeling the interleaf sheet from the image recording material; and an interleaf sheet discarding mechanism discarding the interleaf sheet, which has been peeled-off, along a different path than the conveying path of the conveying mechanism.

In accordance with the third aspect of the present invention, cassettes are accommodated at plural levels in the vertical direction in the cassette accommodating section. When image recording materials and interleaf sheets are loaded in each cassette, the position of contact when the image recording material and the interleaf sheet are simultaneously carried out as a pair by the carry-out mechanism differs. Thus, loci of movement which are appropriate for the respective cassettes are set. The pair of the image recording material and the interleaf sheet are carried out on the basis of the set locus of movement.

The image recording material and the interleaf sheet which have been carried out are conveyed along the predetermined conveying path by the conveying mechanism. The peeling mechanism is provided along the conveying path. The interleaf sheet is peeled from the image recording material, and is discarded, by the interleaf sheet discarding mechanism, on a path which is different than the aforementioned conveying path.

In this way, even if the cassettes are not changed, the image recording material and the interleaf sheet can be carried out along loci of movement which are suited to the respective cassettes. Therefore, the workability improves. Moreover, because the image recording material and the interleaf sheet are carried out simultaneously and the interleaf sheet is peeled off along the conveying path, an operational step for eliminating the interleaf sheet from the cassette can be omitted, and the sheet conveying processing can be made to be faster.

In the third aspect, the following structure is possible: the image recording surface of the image recording material in the cassette faces downward, and the interleaf sheet, which forms the pair with the image recording material, is disposed on the top surface of the image recording material, and at the time of carrying out by the carry-out mechanism, the carry-out mechanism transfers the image recording material and the interleaf sheet to the conveying path while simultaneously inverting the image recording material and the interleaf sheet.

In such a structure, when the image recording material is carried out, the image recording surface is made to face downward because it is easily scratched. The interleaf sheet protects the image recording surface. However, the interleaf sheet which protects the image recording surface of the image recording material of one layer, and the image recording material which is to be carried out, are a pair. In this way, in a case in which the pair is sucked and held by, for example, suction cups or the like at the time of carrying out, it is the interleaf sheet which is directly contacted. The reverse surface of the image recording material (the surface opposite the image recording surface) is beneath the thin interleaf sheet. Therefore, it is possible to avoid damage to the image recording surface due to the carrying-out of the image recording material and the interleaf sheet.

There are cases in which the image recording surface must be facing upward in the subsequent process (e.g., the image recording process). Thus, at the time of carrying out, by inverting the image recording material and the interleaf sheet which are being simultaneously carried out, the image recording material and the interleaf sheet are transferred to the conveying path with the orientations thereof changed. In this way, it is possible to achieve correspondence with the subsequent step.

Moreover, the following structure is possible in the third aspect: the image recording surface of the image recording material in the cassette faces upward, and the interleaf sheet, which forms the pair with the image recording material, is disposed on the image recording surface, and at the time of carrying out by the carry-out mechanism, the carry-out mechanism transfers the image recording material and the interleaf sheet to the conveying path while maintaining the top/bottom positional relationship of the time when the image recording material and the interleaf sheet were accommodated in the cassette.

When the image recording surface of the image recording material faces upward, the image recording material, and the interleaf sheet thereon which protects the image recording surface, are handled as a pair. In this case, if the orientation of the image recording surface in the subsequent process (e.g., the image recording process) is upward, the image recording material and the interleaf sheet accommodated in the cassette are transferred to the conveying path with their top/bottom relationship maintained. In this way, it is possible to achieve correspondence with the subsequent step.

In the third aspect, the peeling mechanism may be structured so as to have: a retarding roller provided at the interleaf sheet side, and able to approach and move away from the conveying path of the interleaf sheet, and rotating so as to impart conveying force in a direction opposite to the conveying direction; a leading end detecting sensor provided at a conveying direction downstream side of the retarding roller, and detecting a leading end portion of the interleaf sheet or the image recording material; a moving mechanism which holds the retarding roller in a state of being separated from the conveying path, and which, at the point in time when the leading end detecting sensor detects the interleaf sheet or the image recording material, moves the retarding roller such that the retarding roller approaches the conveying path; and a guiding mechanism which, due to the retarding roller being made to contact the interleaf sheet by the moving mechanism, returns the interleaf sheet in the direction opposite to the conveying direction and guides the interleaf sheet to the different path.

In this structure, when, while being conveyed along the conveying path, the image recording material and the interleaf sheet pass by the retarding roller which is at a position apart from the conveying path, thereafter, the leading end portions of the image recording material and the interleaf sheet are detected by the leading end detecting sensor.

In accordance with this detection, due to the moving mechanism, the retarding roller approaches the conveying path and contacts the interleaf sheet. The retarding roller imparts, to the interleaf sheet, conveying force in a direction opposite to the direction of conveying of the conveying path. Therefore, the interleaf sheet, which has passed by the retarding roller, is returned in the aforementioned opposite direction, and is guided to the different path by the guiding mechanism.

In this way, it is possible to eliminate only the interleaf sheet, without hindering the conveying of the image recording material. The image recording material can be efficiently conveyed to the subsequent process (e.g., the image recording process).

A fourth aspect of the present invention is an automatic image recording system comprising: (A) a sheet conveying device having: (i) a cassette accommodating section accommodating at least two cassettes which are disposed one above another in a vertical direction and in which image recording materials and interleaf sheets are accommodated in a state of being stacked alternately, where, at the image recording material, an image recording surface is provided on a support, and the interleaf sheet is thin-film-shaped and protects the image recording surface; (ii) a carry-out mechanism simultaneously carrying the image recording material and the interleaf sheet as a pair out from the cassette in a state in which the interleaf sheet and the image recording material are superposed with the interleaf sheet on a top side and the image recording material at a bottom side; (iii) a conveying mechanism which, after the pair of the image recording material and the interleaf sheet have been selectively carried out from the plural cassettes by the carry-out mechanism, conveys the pair of the image recording material and the interleaf sheet from a carry-out position along a predetermined conveying path; (iv) a peeling mechanism provided along the conveying path of the conveying mechanism, and peeling the interleaf sheet from the image recording material; and (v) an interleaf sheet discarding mechanism discarding the interleaf sheet, which has been peeled-off, along a different path than the conveying path of the conveying mechanism; and (B) an exposing device having a drum and a recording head, and in a state in which the image recording material, which has been separated from the interleaf sheet conveyed by the conveying mechanism, is trained around the drum, while rotating the drum at high speed, illuminating a light beam from the recording head, and moving the recording head in an axial direction to the drum, and thereby recording an image on the image recording material.

In accordance with the fourth aspect of the present invention, the image recording material, which is conveyed in the above-described sheet conveying device of the third aspect, is trained around the drum. In the state in which the image recording material is trained therearound, the drum is rotated at high speed. Synchronously therewith, a light beam is illuminated while the recording head is moved in the axial direction of the drum. The light beam is controlled to be turned on and off on the basis of, for example, image data inputted from the exterior. An image is thereby recorded onto the image recording surface of the image recording material.

Due to this system which combines an image recording device and the above-described sheet conveying device, the steps from the taking-out of the image recording material to the recording of an image can be carried out automatically. It is possible to eliminate the previously-required manual work of handling or the like by a worker in order to protect the image recording surface in particular.

DETAILED DESCRIPTION OF THE INVENTION

Figure 1:
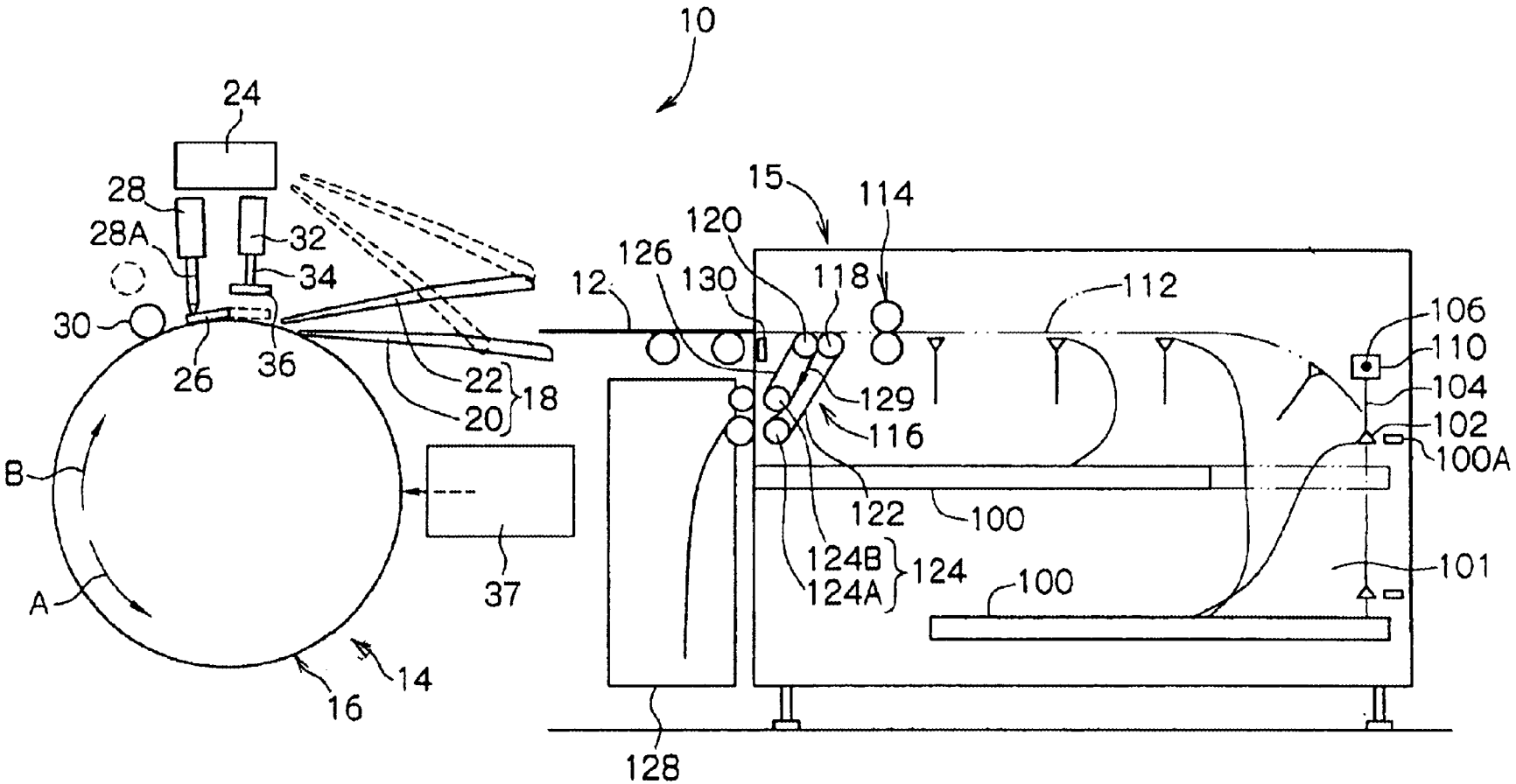
FIG. 1 is a schematic diagram of an automatic printing plate exposing device relating to an embodiment of the present invention.

An automatic printing plate image recording system 10 relating to the present embodiment is shown in FIG. 1.

The automatic printing plate image recording system 10 is divided into two main sections which are an exposure section 14, which illuminates a light beam onto an image forming layer of a printing plate 12 so as to expose an image, and a sheet conveying section 15 which conveys the printing plates 12 one-by-one to the exposure section 14. The printing plate 12, which has been subjected to exposure processing by the automatic printing plate image recording system 10, is fed out to a developing device (not illustrated) which is disposed adjacent to the automatic printing plate image recording system 10.

(Structure of Exposure Section)

As shown in FIG. 1, the exposure section 14 is structured such that a rotating drum 16, around whose peripheral surface the printing plate 12 is trained and held, is the main portion of the exposure section 14. The printing plate 12 is guided by a conveying guide unit 18, and is fed into the exposure section 14 from a direction agent to the rotating drum 16. A puncher 24 is disposed above (in FIG. 1) the rotating drum 16.

The conveying guide unit 18 is structured by a plate supplying guide 20 and a plate discharging guide 22.

The relative positional relationship of the plate supplying guide 20 and the plate discharging guide 22 of the conveying guide unit 18 is such that the plate supplying guide 20 and the plate discharging guide 22 form a sideways V shape. The plate supplying guide 20 and the plate discharging guide 22 rotate by predetermined angles around the right end portion sides thereof in FIG. 1. Due to this rotation, the plate supplying guide 20 and the plate discharging guide 22 can selectively be made to correspond to and guide the printing plate 12 to the rotating drum 16 or the puncher 24.

The printing plate 12 is first guided by the plate supplying guide 20 and fed into the puncher 24 where notches for positioning are formed in the leading end of the printing plate 12.

After the printing plate 12 undergoes processing at the puncher 24, the printing plate 12 is returned to the plate supplying guide 20. Next, the printing plate 12 is moved to a position corresponding to the rotating drum 16.

The rotating drum 16 is rotated by an unillustrated driving mechanism in a direction in which the printing plate 12 is attached and exposed (the direction of arrow A in FIG. 1), and in a direction in which the printing plate 12 is removed (the direction of arrow B in FIG. 1) which is opposite to the attaching/exposing direction.

As shown in FIG. 1, leading end chucks 26 are mounted to predetermined positions of the outer peripheral surface of the rotating drum 16 provided in the exposure section 14. At the exposure section 14, when the printing plate 12 is to be attached to the rotating drum 16, first, the rotating drum 16 is stopped at a position (the printing plate attaching position) at which the leading end chucks 26 oppose the leading end of the printing plate 12 which has been fed in by the plate supplying guide 20 of the conveying guide unit 18.

An attaching unit 28 is provided in the exposure section 14 so as to oppose the leading end chucks 26 at the printing plate attaching position. Due to extending/retracting rods 28A of the attaching unit 28 extending and pushing one end sides of the leading end chucks 26, the leading end chucks 26 open and the printing plate 12 can be inserted between the leading end chucks 26 and the peripheral surface of the rotating drum 16.

In the exposure section 14, in the state in which the leading end of the printing plate 12 is inserted between the leading end chucks 26 and the rotating drum 16, the extending/retracting rods 28A of the attaching unit 28 are pulled back such that their pressing of the leading end chucks 26 is released. In this way, the leading end of the printing plate 12 is nipped and held between the leading end chucks 26 and the peripheral surface of the rotating drum 16.

At this time, the printing plate 12 is positioned due to the leading end thereof abutting positioning pins (not shown) provided on the rotating drum 16.

At the exposure section 14, when the leading end of the printing plate 12 is fixed to the rotating drum 16, the rotating drum 16 is rotated in the attaching/exposing direction. In this way, the printing plate 12, which has been fed in from the plate supplying guide 20 of the conveying guide unit 18, is trained about the peripheral surface of the rotating drum 16.

A squeeze roller 30 is provided at the downstream side, in the attaching/exposing direction, of the printing plate attaching position, in a vicinity of the peripheral surface of the rotating drum 16. Due to the squeeze roller 30 moving toward the rotating drum 16, the printing plate 12 which is trained on the rotating drum 16 is pushed toward the rotating drum 16 and is made to fit tightly to the peripheral surface of the rotating drum 16.

Further, a trailing end chuck attaching/detaching unit 32 is disposed in the exposure section 14 at the upstream side, in the rotating drum 16 attaching/exposing direction (direction A), of the squeeze roller 30, and in a vicinity of the upstream side of the home position of the leading end chucks 26. At the trailing end chuck attaching/detaching unit 32, trailing end chucks 36 are attached to the distal ends of shafts 34 which project toward the rotating drum 16. In a standby state, the trailing end chucks 36 are held in a state of being separated from the rotating drum 16.

In the exposure section 14, when the trailing end of the printing plate 12 which is trained on the rotating drum 16 opposes the trailing end chuck attaching/detaching unit 32, the shafts 34 are projected such that the trailing end chucks 36 are attached to predetermined positions of the rotating drum 16. In this way, the trailing end of the printing plate 12 is nipped and held between the trailing end chucks 36 and the rotating drum 16.

In the exposure section 14, when the leading end and the trailing end of the printing plate 12 are held at the rotating drum 16, the squeeze roller 30 is moved away. Thereafter, in the exposure section 14, while rotating the rotating drum 16 at high speed at a predetermined rotational speed (main scanning), synchronously with this rotation of the rotating drum 16, a light beam, which is modulated on the basis of image data, is irradiated while a recording head portion 37 is moved in the axial direction of the rotating drum 16.

As shown in FIG. 1, in the exposure section 14, when the scan-exposure of the printing plate 12 has been completed, the rotating drum 16 is temporarily stopped at a position at which the trailing end chucks 36, which are holding the trailing end of the printing plate 12, opposes the trailing end chuck attaching/detaching unit 32. The trailing end chuck attaching/detaching unit 32 removes the trailing end chucks 36 from the rotating drum 16. In this way, the trailing end of the printing plate 12 is freed.

Thereafter, by rotating the rotating drum 16 in the direction of removing the printing plate 12 (direction B), the printing plate 12 is discharged, from the trailing end side thereof, to the plate discharging guide 22 of the conveying guide unit 18 along a direction tangent to the rotating drum 16. Thereafter, the printing plate 12 is conveyed to the developing device which is the subsequent process.

(Structure of Sheet Conveying Section)

As shown in FIG. 1, a cassette accommodating section 101 is provided at the sheet conveying section 15. The cassette accommodating section 101 accommodates a plurality of cassettes 100 (in the present embodiment, two cassettes 100 with one above the other) which are parallel to the surface on which the device is placed.

As shown in FIG. 1, a moving mechanism 110 is provided above the cassette accommodating section 101. In the moving mechanism 110, suction cups 102 are supported via arms 104 so as to hang downward. Base points 106, which support this downward hanging, are movable substantially horizontally in the left-right direction (in FIG. 1) of the cassettes 100.

The moving mechanism 110 is structured by a plate which supports the plurality of suction cups 102 along the transverse direction of the cassettes 100, and a pair of rails across which the plate spans. (The plate and the rails are not illustrated.)

The base points 106 which support the suction cups 102 are rotatable. Here, when the printing plate 12 is to be carried out from the cassette 100, the plate to which the suction cups 102 are mounted is positioned on the rails at the right end portion, in FIG. 1, of the cassette 100.

Figure 2:
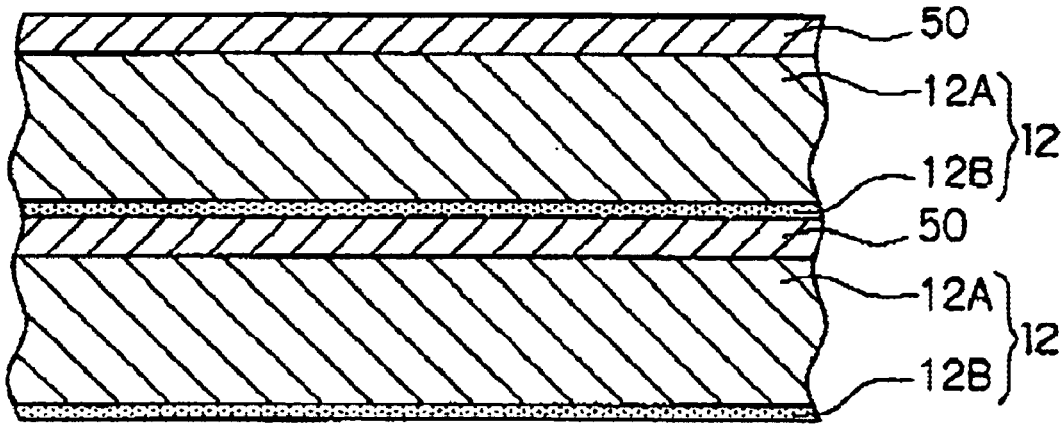
FIG. 2 is a side view showing a state in which interleaf sheets and printing plates are stacked in a cassette applied to the automatic printing plate exposing device relating to the embodiment of the present invention.

As shown in FIG. 2, interleaf sheets 50 and the printing plates 12 are stacked alternately in the cassette 100 with the uppermost layer being the interleaf sheet 50 and the next layer being the printing plate 12 which is disposed with a support 12A and a photosensitive layer 12B thereof facing downward.

Thus, the suction cups 102 directly contact the interleaf sheet 50 which is the uppermost layer within the cassette 100.

When suction force is imparted to the suction cups 102 at the point in time when they contact the uppermost interleaf sheet 50, the suction force is applied to the uppermost interleaf sheet 50, as well as to the printing plate 12 immediately therebeneath. The interleaf sheet 50 and the printing plate 12 are thereby sucked and raised up as a pair.

At this time, the suction cups 102 rise up to a position at which the interleaf sheets 50 and the printing plates 12, which are other than and which are beneath the interleaf sheet 50 and the printing plate 12 which are being sucked, can be separated by abutting a separating plate 100A provided at the cassette 100.

In the state in which this separating by the separating plate 100A has been completed, the plate supporting the suction cups 102 begins to rotate counterclockwise in FIG. 1 around the base points 106, and begins to move toward the left, in FIG. 1, of the cassette 100 along the rails. In this way, the suction points of the suction cups 102 move while tracing for example, an approximately cycloid curve.

When the suction cups 102 have been rotated by 180°, the interleaf sheet 50 and the printing plate 12 are curved in a sideways U shape such that the interleaf sheet 50 is at the lower side and the printing plate 12 is at the upper side in the state shown in FIG. 1. At least the leading end portions thereof are positioned on a conveying path 112, and the interleaf sheet 50 and the printing plate 12 are transferred to conveying rollers 114.

Note that, at the moving mechanism 110, a locus of movement is set in correspondence with each of the cassettes 100. Namely, the suction positions of the suction cups 102 differ in accordance with the left-right positions (in FIG. 1) of the cassettes 100 and the difference therebetween in the heightwise direction. Therefore, loci of movement which are appropriate for the respective cassettes 100 are set, and the moving mechanism 110 moves on the basis of these settings. Note that, when taking the printing plate 12 and the interleaf sheet 50 out from the bottommost cassette 100 in particular, the locus of movement is set so as to prevent interference with the cassette 100 thereabove.

An interleaf sheet peeling unit 116 is disposed at the downstream side of the conveying rollers 114.

In the present embodiment, at the time when the printing plate 12 and the interleaf sheet 50 reach the conveying rollers 114, the interleaf sheet is positioned at the bottom surface side of the printing plate 12. Therefore, the interleaf sheet peeling unit 116 is disposed beneath the conveying path.

The peeling unit 116 has a conveying roller 118 and an interleaf sheet peeling roller 120 which are disposed at the upstream and downstream sides of one another along the conveying path. Namely, the conveying roller 118 is at the upstream side and the interleaf sheet peeling roller 120 is at the downstream side.

An endless belt 122 is trained around the conveying roller 118. The belt 122 is trained around a lower roller 124A of a pair of discharging end rollers 124 which are disposed below the conveying roller 118 (i.e., in the direction of moving away from the conveying path) and at the downstream side of the conveying roller 118.

An endless belt 126 is trained around the interleaf sheet peeling roller 120 as well. The belt 126 is trained around the upper roller 124B of the discharging end rollers 124.

A forked-off path 129, which leads to an interleaf sheet accommodating box (interleaf sheet stacking section) 128, is formed beneath the conveying path by these two belts 122, 126.

The conveying roller 118 is driven to rotate counterclockwise in FIG. 1. The interleaf sheet peeling roller 120 is driven to rotate clockwise in FIG. 1. Therefore, when the interleaf sheet 50 is nipped by the two belts 122, 126, the interleaf sheet 50 is guided and conveyed from the conveying path to the interleaf sheet accommodating box 128.

Here, the interleaf sheet peeling roller 120 is movable in directions of approaching and moving away from the conveying path. Usually, the interleaf sheet peeling roller 120 is held at a position of being separated from the conveying path. Namely, the interleaf sheet peeling roller 120 does not contact the printing plate 12 and the interleaf sheet 50 which are nipped and conveyed in by the conveying rollers 114. Therefore, the rotational driving force of the interleaf sheet peeling roller 120, which rotational driving force is in the direction opposite to the conveying direction of the printing plate 12 and the interleaf sheet 50, is not applied to the interleaf sheet 50.

A leading end detecting sensor 130 is provided at the conveying path at the downstream side of the interleaf sheet peeling roller 120. The signal of the leading end detecting sensor 130 is inverted by the presence/absence of the printing plate 12 conveyed in along the conveying path. Therefore, at the point in time when the leading end portion of the printing plate 12 reaches the leading end detecting sensor 130, the signal is inverted.

When the printing plate 12 is detected by the leading end detecting sensor 130 (at this point in time, the interleaf sheet 50 is adhered thereto), the interleaf sheet peeling roller 120 is moved in the direction of approaching the conveying path. The driving force of the interleaf sheet peeling roller 120 (driving force in the direction opposite to the conveying direction) is transmitted to the interleaf sheet 50. The interleaf sheet 50, which has passed through up to the leading end detecting sensor 130, is returned.

On the other hand, the conveying roller 118 continues the feeding of the interleaf sheet 50 and the printing plate 12 along the conveying path. Therefore, the interleaf sheet 50 goes slack between the conveying roller 118 and the interleaf sheet peeling roller 120, and this slack portion is nipped by the two belts 122, 126.

When a period of time corresponding to the returned amount of the interleaf sheet 50 elapses, the interleaf sheet peeling roller 120 is returned to its regular position (the position of being separated from the conveying path). Therefore, the interleaf sheet peeling roller 120 does not contact the printing plate 12, and the printing plate 12 and the interleaf sheet peeling roller 120 do not slide against each other.

Due to the interleaf sheet 50 being nipped by the two belts 122, 126, the interleaf sheet 50 is conveyed along the forked-off path 129 and guided and discharged to the interleaf sheet accommodating box 130.

Operation of the present embodiment will be described hereinafter.

When recording of an image onto the printing plate 12 instructed, first, the cassette 100 is selected. For example, the printing plates 12 of different sizes are accommodated in the cassettes 100 respectively. The cassette 100 which accommodates the printing plates 12 of the designated size is selected.

When the cassette 100 is selected, the locus of movement of the moving mechanism 110 is selected on the basis of what vertical direction level that cassette 100 is located at. Namely, in the case of the upper cassette 100 and in the case of the lower cassette 100, the suction positions in the lateral directions (in FIG. 1) differ, and the amounts of lowering of the suction cups 102 which are lowered at the time of sucking differ. Therefore, for each of the cassettes 100, a locus of movement which is appropriate thereto is set. Note that, in the case of the lower cassette 100, a locus of movement which prevents interference between the cassette 100 thereabove and the printing plate 12 (or the interleaf sheet 50) which is being carried out, is set.

When the above-described setting of the locus of movement is completed, the suction cups 102 of the moving mechanism 110 are lowered and contact the interleaf sheet 50 which is the uppermost layer. When suction is started in this state, because the interleaf sheet 50 is air permeable, the suction force reaches the printing plate 12 therebeneath. Accordingly, when the suction cups 102 are raised after the suction is started, the interleaf sheet 50 and the printing plate 12 therebeneath receive the suction force and are taken out as a pair.

At this time, there are cases in which the interleaf sheet 50 or the printing plate 12 further beneath stick to the sucked printing plate 12 due to static electricity or the like. In such a case, the printing plate 12 or the like which is sticking due to the static electricity or the like is removed by abutting the separating plate 100A. The interleaf sheet 50 and the printing plate 12, which are being carried out only by the suction force of the suction cups 102, are carried out.

Synchronously with the carrying out by the suction cups 102, the arms 104 begin to rotate counterclockwise in FIG. 1, and the base points 106 move toward the left in FIG. 1 along the conveying path 112. In this way, the leading end portions of the printing plate 12 and the interleaf sheet 50 arrive on the conveying path 112 in an inverted state. Namely, the printing plate 12 is the top layer and the interleaf sheet 50 is the bottom layer.

In this state, the printing plate 12 and the interleaf sheet 50 are nipped by the conveying rollers 114, are conveyed substantially horizontally toward the left in FIG. 1, pass through the interleaf sheet peeling unit 116, and are fed toward the exposure section 14.

Here, when the printing plate 32 is fed out toward the exposure section 14, the interleaf sheet 50 is not needed, and the interleaf sheet 50 is taken off by the interleaf sheet peeling unit 116.

The order of operations at the interleaf sheet peeling unit 116 will be described in accordance with FIGS. 3A through 3D.

Figure 3A:
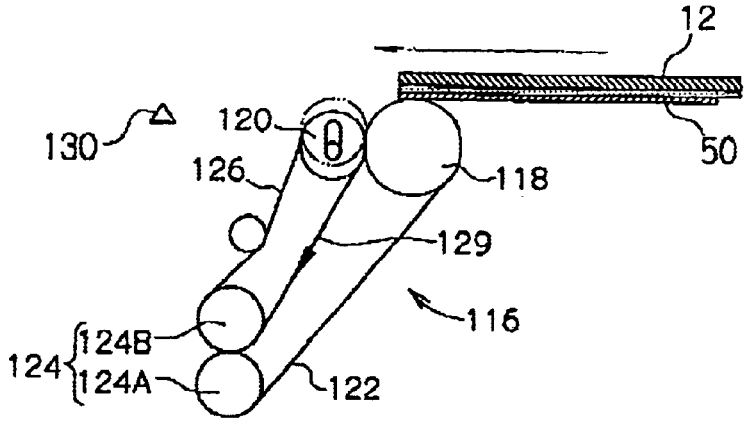
FIGS. 3A through 3D are side views showing respective processes of a peeling operation of an interleaf sheet peeling unit.
Figure 3B:
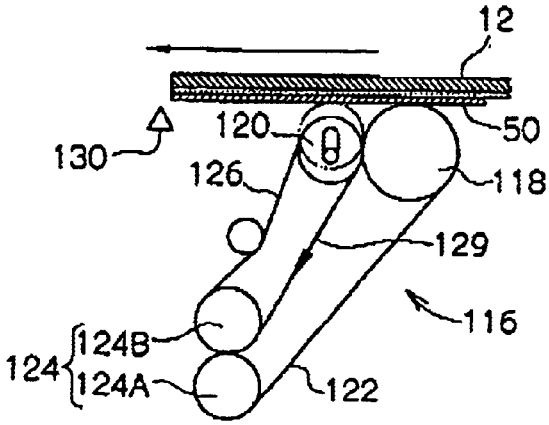
Figure 3C:
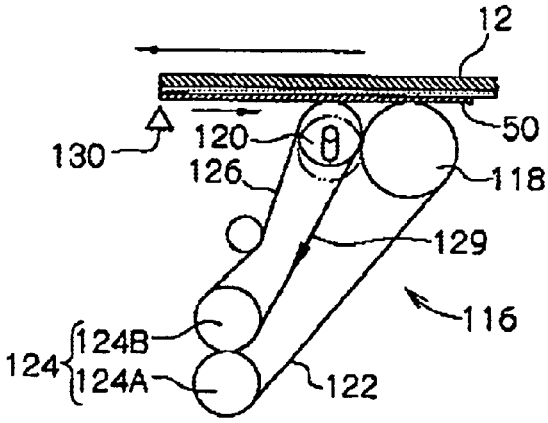
Figure 3D:
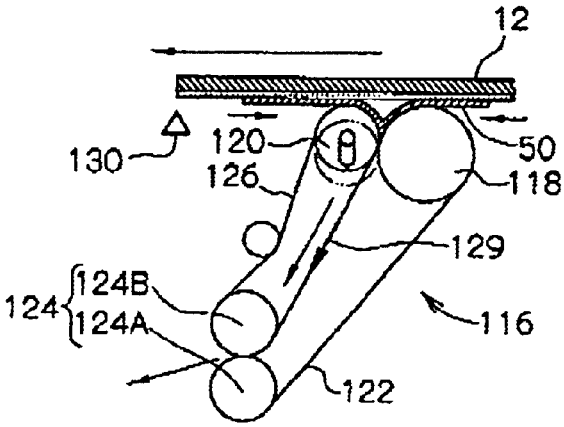
Figure 4:
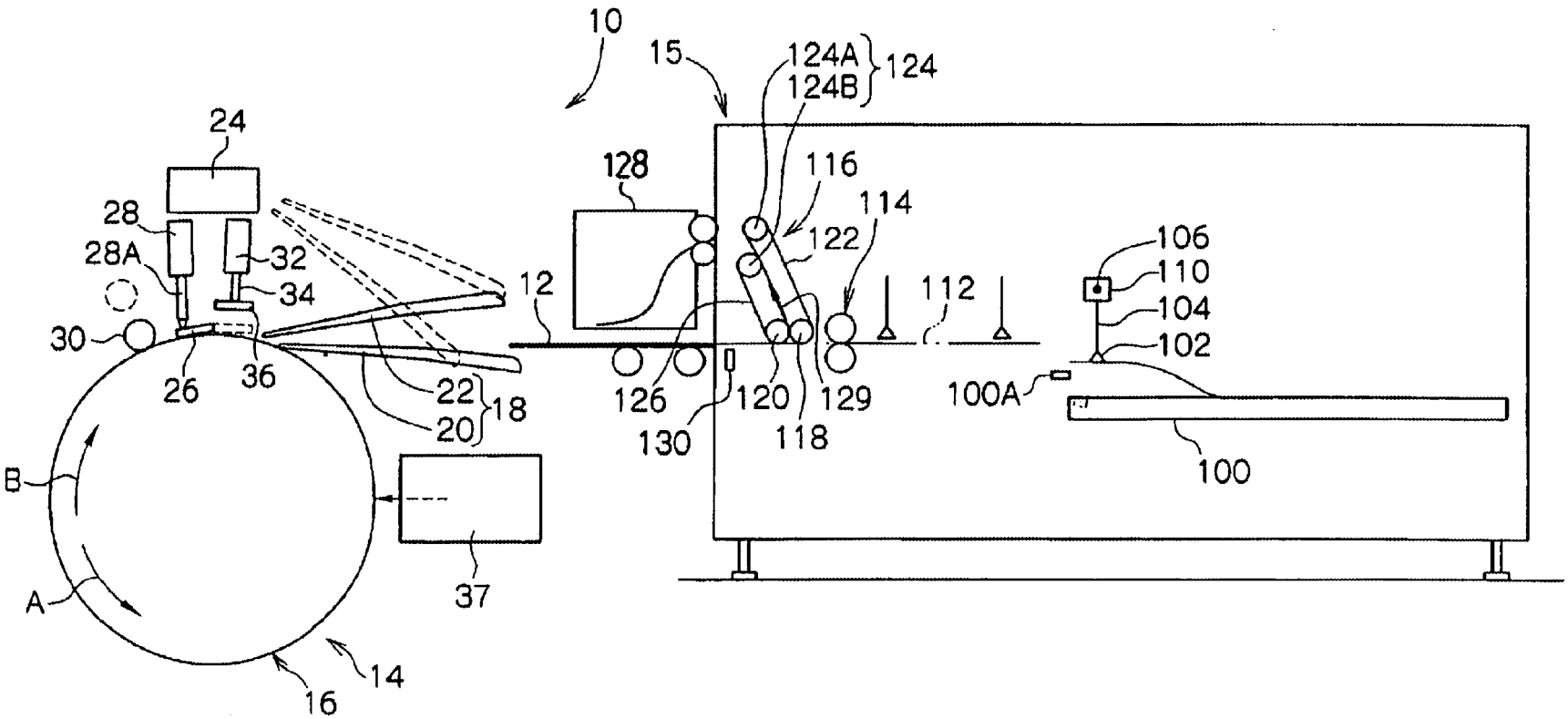
FIG. 4 shows an alternative exemplary embodiment of the invention.

First, the interleaf sheet peeling roller 120 is maintained in the state of being separated from the conveying path 112 (see FIG. 3A). In this state, the printing plate 12 and the interleaf sheet 50, which are nipped and conveyed by the conveying rollers 114, pass by the interleaf sheet peeling roller 120 (see FIG. 3B). Therefore, the conveying force of the interleaf sheet peeling roller 120 is not applied to the interleaf sheet 50.

When the printing plate 12 and the interleaf sheet 50 pass by the interleaf sheet peeling roller 120, the leading ends thereof are detected by the leading end detecting sensor 130. Due to this detection the interleaf sheet peeling roller 120 begins to move in the direction of approaching the conveying path 112. Due to this movement, the interleaf sheet peeling roller 120 contacts the interleaf sheet 50 (see FIG. 3C).

The interleaf sheet peeling roller 120 applies, to the interleaf sheet 50, conveying force in the direction opposite to the direction of conveying by the conveying path 112. Therefore, the interleaf sheet 50 which has passed by the interleaf sheet peeling roller 120 is returned. At this time, the conveying force of the interleaf sheet peeling roller 120 is not applied to the printing plate 12. Therefore, only the interleaf sheet 50 is returned. As a result, the leading end portions of the printing plate 12 and the interleaf sheet 50 are peeled apart from one another.

On the other hand, the conveying roller 118 continues to apply conveying force along the conveying path 112 (conveying force toward the left in FIG. 1) to the interleaf sheet 50. Therefore, slack arises in the interleaf sheet 50 between the conveying roller 118 and the interleaf sheet peeling roller 120 (see FIG. 3D). This slack portion is nipped by the two belts 122, 126 and is guided to the forked-off path 129. Thus, the interleaf sheet 50 is fed-out to the forked-off path 129, and is discarded in the interleaf sheet accommodating box 128.

During the operation of discarding the interleaf sheet as well, the printing plate 12 continues to be conveyed horizontally along the conveying path 112, and is fed to the plate supplying guide 20 of the exposure section 14.

The processes of the exposure processing at the exposure section 14 are as follows.

The printing plate 12 on the plate supplying guide 20 is fed-in toward the rotating drum 16, and the leading end portion of the printing plate 12 is held by the leading end chucks 26. Due to the rotating drum 16 being rotated in this state, the printing plate 12 is trained tightly onto the peripheral surface of the rotating drum 16. Thereafter, due to the trailing end of the printing plate 12 being held by the trailing end chucks 36, preparations for exposure are completed.

In this state, the image data is read, and exposure processing by the light beam from the recording head portion 37 is started. The exposure processing is so-called scan-exposure in which the recording head portion 37 moves in the axial direction of the rotating drum 16 while the rotating drum 16 is rotated at high speed (main scanning).

When exposure processing is completed, the conveying guide unit 18 is switched (the plate discharging guide 22 is made to correspond to the rotating drum 16). Then, the printing plate 12 trained on the rotating drum 16 is discharged out from a direction tangent to the rotating drum 16. At this time, the printing plate 12 is fed to the plate discharging guide 22.

When the printing plate 12 is fed to the plate discharging guide 22, the conveying guide unit 18 is switched such that the plate discharging guide 22 is made to correspond to the discharge opening and discharges the printing plate 12. The developing section is provided in this direction of discharging, and the printing plate 12 is subsequently subjected to developing processing.

As described above, in the present embodiment, the printing plate 12 (and the interleaf sheet 50) are carried out from the cassette 100 by the suction of the suction cups 102, and are transferred to the conveying path 112 which leads to the exposure section 14 while being inverted by 180° in order to correspond to the requirements of the exposure section 14. During this conveying at the conveying path 112, the interleaf sheet peeling roller 120 is rotated in the direction opposite to the direction of conveying to the exposure section 14. In this way, only the interleaf sheet 50 which has passed by the interleaf sheet peeling roller 120 is returned. Slack arises in the interleaf sheet 50 between the interleaf sheet peeling roller 120 and the conveying roller 118. This slack portion is nipped by the two belts 122, 126 and is fed to the forked-off path 129. Therefore, it is possible to feed only the printing plate 12 out to the exposure section 14 while continuing to convey the printing plate 12.

In this way, as compared with the conventional process in which the printing plate 12 and the interleaf sheet 50 are carried out alternately from the cassette, the number of processes can be reduced, and efficient image recording is possible.

Note that in the present embodiment, the interleaf sheet roller 120 is used as the peeling mechanism for peeling off the interleaf sheet 50. However, a structure may be used in which, by sucking the interleaf sheet 50 by a suction fan, the interleaf sheet 50 is peeled off from the printing plate 12, and is guided to the forked-off path 129.

As described above, the present invention has the excellent effect that an image recording material and an interleaf sheet are taken out without separating the image recording material and the interleaf sheet, and it is possible to convey only the image recording material to a subsequent process without scratching the image recording surface of the image recording material.

In addition to the above effect, the present invention also has the effect that, in the processes from the taking-out from a cassette to the recording of an image, the workability for taking off an interleaf sheet can be improved, and efficient automation processing can be realized.

What is claimed is:

1. An image recording material sheet conveying device comprising:

a cassette accommodating section having at least one cassette in which image recording materials and interleaf sheets are accommodated in a state of being stacked alternately, where the image recording material is sheet-shaped and has a support and an image recording surface is formed on one surface of the support, and the interleaf sheet is sheet-shaped and is for protecting the image recording surface;

a take-out mechanism taking a pair of the image recording material and the interleaf sheet out from the cassette in a state in which the interleaf sheet is superposed on the image recording material;

a conveying mechanism receiving the pair of the image recording material and the interleaf sheet from the take-out mechanism, and conveying the pair of the image recording material and the interleaf sheet in a predetermined conveying direction along a conveying path; a peeling mechanism peeling, at the conveying path, the interleaf sheet from the image recording material; and an interleaf sheet conveying mechanism conveying the interleaf sheet, which has been peeled-off, along a path which is different than the conveying path.

2. The sheet conveying device of claim 1, wherein the cassette accommodating section has at least two cassettes which are disposed at different positions in a vertical direction, and the take-out mechanism selects any one cassette, and takes the pair of the image recording material and the interleaf sheet out from said cassette.

3. The sheet conveying device of claim 1, wherein the take-out mechanism takes the pair of the image recording material and the interleaf sheet out from the cassette such that the interleaf sheet is positioned substantially at a top side and the image recording material is positioned at a bottom side.

4. The sheet conveying device of claim 1, wherein the take-out mechanism has a suction mechanism for holding the pair of the image recording material and the interleaf sheet.

5. The sheet conveying device of claim 1, wherein the take-out mechanism holds the pair of the image recording material and the interleaf sheet from an interleaf sheet side.

6. The sheet conveying device of claim 1, wherein the image recording materials are accommodated in the cassette with the image recording surfaces facing downward, and the take-out mechanism takes the pair of the image recording material and the interleaf sheet out with the interleaf sheet superposed on the image recording material, and inverts the pair and transfers the pair to the conveying mechanism.

7. The sheet conveying device of claim 1, wherein the image recording materials are accommodated in the cassette with the image recording surfaces facing upward, and the take-out mechanism takes the pair of the image recording material and the interleaf sheet out with the interleaf sheet superposed on the image recording material, and transfers the pair to the conveying mechanism with the interleaf sheet positioned as is on the image recording material.

8. The sheet conveying device of claim 1, wherein the peeling mechanism has:

a retarding roller held in a state of being separated from the conveying path, and disposed so as to be able to approach and move away from the interleaf sheet conveyed on the conveying path, and contacting the interleaf sheet and being rotated so as to impart conveying force to the interleaf sheet in a direction opposite to the conveying direction;

a leading end detecting sensor provided at a conveying direction downstream side of the retarding roller, and detecting a leading end portion of one of the interleaf sheet and the image recording material; and a moving mechanism which, on the basis of results of detection of the leading end detecting sensor, moves the retarding roller so as to make the retarding roller contact the interleaf sheet conveyed on the conveying path, wherein due to the retarding roller contacting the interleaf sheet, the interleaf sheet is returned in the direction opposite to the conveying direction, and the interleaf sheet is guided to the path which is different than the conveying path.

9. The sheet conveying device of claim 1, wherein the interleaf sheet conveying mechanism has an interleaf sheet stacking section, and the interleaf sheet which has been separated is conveyed to the interleaf sheet stacking section.

10. An automatic image recording system comprising:

a cassette accommodating section having a cassette in which image recording materials and interleaf sheets are accommodated in a state of being stacked alternately, where the image recording material is sheet-shaped and has a support and an image recording surface is formed on one surface of the support, and the interleaf sheet is sheet-shaped and is for protecting the image recording surface;

a take-out mechanism taking a pair of the image recording material and the interleaf sheet out from the cassette in a state in which the interleaf sheet is superposed on the image recording material;

a conveying mechanism receiving the pair of the image recording material and the interleaf sheet from the take-out mechanism, and conveying the pair of the image recording material and the interleaf sheet in a predetermined conveying direction along a conveying path; a peeling mechanism peeling, at the conveying path, the interleaf sheet from the image recording material;

an interleaf sheet conveying mechanism conveying the interleaf sheet, which has been peeled-off, along a path which is different than the conveying path; and an exposure station having a drum and a recording head, and training the image recording material, which has been separated from the interleaf sheet conveyed by the conveying mechanism, around the drum, and while rotating the drum at high speed, illuminating a light beam from the recording head, and moving the recording head relative to the drum, and thereby recording an image on the image recording material.

11. An image recording material sheet conveying device comprising:

a cassette accommodating section accommodating at least two cassettes which are disposed one above another in a vertical direction and in which image recording materials and interleaf sheets are accommodated in a state of being stacked alternately, where, at the image recording material, an image recording surface is provided on a support, and the interleaf sheet is thin-film-shaped and protects the image recording surface;

a carry-out mechanism simultaneously carrying the image recording material and the interleaf sheet as a pair out from the cassette in a state in which the interleaf sheet and the image recording material are superposed with the interleaf sheet on a top side and the image recording material at a bottom side;

a conveying mechanism which, after the pair of the image recording material and the interleaf sheet have been selectively carried out from the plural cassettes by the carry-out mechanism, conveys the pair of the image recording material and the interleaf sheet from a carry-out position along a predetermined conveying path;

a peeling mechanism provided along the conveying path of the conveying mechanism, and peeling the interleaf sheet from the image recording material; and an interleaf sheet discarding mechanism discarding the interleaf sheet, which has been peeled-off, along a different path than the conveying path of the conveying mechanism.

12. The sheet conveying device of claim 11, wherein the image recording surface of the image recording material in the cassette faces downward, and the interleaf sheet, which forms the pair with the image recording material, is disposed on a top surface of the image recording material, and at a time of carry-out by the carry-out mechanism, the carry-out mechanism transfers the image recording material and the interleaf sheet to the conveying path while simultaneously inverting the image recording material and the interleaf sheet.

13. The sheet conveying device of claim 11, wherein the image recording surface of the image recording material in the cassette faces upward, and the interleaf sheet, which forms the pair with the image recording material, is disposed on the image recording surface, and at a time of carry-out by the carry-out mechanism, the carry-out mechanism transfers the image recording material and the interleaf sheet to the conveying path while maintaining a top/bottom positional relationship of a time when the image recording material and the interleaf sheet were accommodated in the cassette.

14. The sheet conveying device of claim 11, wherein the peeling mechanism has:

a retarding roller provided at an interleaf sheet side of the conveying path, and able to approach and move away from the conveying path of the interleaf sheet, and rotating so as to impart conveying force in a direction opposite to the conveying direction;

a leading end detecting sensor provided at a conveying direction downstream side of the retarding roller, and detecting a leading end portion of one of the interleaf sheet and the image recording material;

a moving mechanism which holds the retarding roller in a state of being separated from the conveying path, and which, at a point in time when the leading end detecting sensor detects one of the interleaf sheet and the image recording material, moves the retarding roller such that the retarding roller approaches the conveying path; and a guiding mechanism which, due to the retarding roller being made to contact the interleaf sheet by the moving mechanism, returns the interleaf sheet in the direction opposite to the conveying direction and guides the interleaf sheet to the different path.

15. An automatic image recording system comprising:

(A) a sheet conveying device having:

(i) a cassette accommodating section accommodating at least two cassettes which are disposed one above another in a vertical direction and in which image recording materials and interleaf sheets are accommodated in a state of being stacked alternately, where, at the image recording material, an image recording surface is provided on a support, and the interleaf sheet is thin-film-shaped and protects the image recording surface;

(ii) a carry-out mechanism simultaneously carrying the image recording material and the interleaf sheet as a pair out from the cassette in a state in which the interleaf sheet and the image recording material are superposed with the interleaf sheet on a top side and the image recording material at a bottom side;

(iii) a conveying mechanism which, after the pair of the image recording material and the interleaf sheet have been selectively carried out from the plural cassettes by the carry-out mechanism, conveys the pair of the image recording material and the interleaf sheet from a carry-out position along a predetermined conveying path;

(iv) a peeling mechanism provided along the conveying path of the conveying mechanism, and peeling the interleaf sheet from the image recording material; and (v) an interleaf sheet discarding mechanism discarding the interleaf sheet, which has been peeled-off, along a different path than the conveying path of the conveying mechanism; and (B) an exposing device having a drum and a recording head, and in a state in which the image recording material, which has been separated from the interleaf sheet conveyed by the conveying mechanism, is trained around the drum, while rotating the drum at high speed, illuminating a light beam from the recording head, and moving the recording head in an axial direction to the drum, and thereby recording an image on the image recording material.

* * * * *